US006102427A

United States Patent [19]

DeRocco et al.

[11] Patent Number: 6,102,427

[45] **Date of Patent: *Aug. 15, 2000**

[54] SKI BINDING LIFTER HAVING INTERNAL FASTENER RETENTION LAYER

[75] Inventors: Anthony O. DeRocco, Seattle; Joe D. Shride, Dockton; James A. Munroe, Bellevue; Bard Glenne, Nordland, all of Wash.

[73] Assignee: K-2 Corporation, Vashon, Wash.

[ * ] Notice: This patent is subject to a terminal disclaimer.

[21] Appl. No.: 08/986,093

[22] Filed: Dec. 5, 1997

[51] Int. Cl.[7] ..... A63C 5/00; A63C 9/00

[52] U.S. Cl. ..... 280/607; 280/609

[58] Field of Search ..... 280/602, 607, 280/609, 610, 617, 618, 611

[56] References Cited

U.S. PATENT DOCUMENTS

| | | | |
|---|---|---|---|
| 3,260,532 | 7/1966 | Heuvel | 280/602 |
| 3,844,576 | 10/1974 | Schultes . | |
| 3,901,522 | 8/1975 | Boehm . | |
| 4,293,142 | 10/1981 | Davignon . | |
| 4,412,687 | 11/1983 | Andre | 280/610 |
| 4,455,037 | 6/1984 | Pilpel et al. . | |
| 4,498,686 | 2/1985 | Pilpel et al. . | |
| 4,556,237 | 12/1985 | Meatto et al. . | |
| 4,565,387 | 1/1986 | Feichtlbauer . | |
| 4,639,009 | 1/1987 | Meatto et al. . | |
| 4,688,821 | 8/1987 | Meatto et al. . | |
| 4,706,985 | 11/1987 | Meatto . | |
| 4,902,548 | 2/1990 | Cholat-Serpoud et al. | 428/102 |
| 4,987,282 | 1/1991 | Chastain . | |
| 5,143,395 | 9/1992 | Mayr . | |
| 5,188,386 | 2/1993 | Schweizer . | |
| 5,199,734 | 4/1993 | Mayr | 280/602 |
| 5,232,241 | 8/1993 | Knott et al. . | |
| 5,253,894 | 10/1993 | Thomas et al. . | |
| 5,303,948 | 4/1994 | Masson et al. | 280/607 |
| 5,344,176 | 9/1994 | Trimble . | |
| 5,346,244 | 9/1994 | Le Masson . | |
| 5,413,371 | 5/1995 | Trimble . | |
| 5,431,427 | 7/1995 | Pieber et al. . | |
| 5,544,908 | 8/1996 | Fezio . | |
| 5,671,940 | 9/1997 | Abondance . | |
| 5,758,894 | 6/1998 | Maggiolo | 280/602 |
| 5,785,342 | 7/1998 | Bronson | 280/602 |
| 5,871,223 | 2/1999 | Zanco | 280/607 |
| 5,884,934 | 3/1999 | DeRocco et al. | 280/607 |

FOREIGN PATENT DOCUMENTS

| | | |
|---|---|---|
| 0 451 132 A2 | 10/1991 | European Pat. Off. . |
| 2 713 101-A1 | 6/1995 | France . |
| WO 95/07737 | 3/1995 | WIPO . |

*Primary Examiner*—Brian L. Johnson
*Assistant Examiner*—Bridget Avery
*Attorney, Agent, or Firm*—Christensen O'Connor Johnson & Kindness PLLC

[57] ABSTRACT

A binding lifter for a ski includes a fastener retention layer, a lifter core extension above and below the fastener retention layer and an exterior layer over at least a portion of the lifter core. The fastener retention layer has a greater density than the lifter core. Binding fasteners are securable to the fastener retention layer.

28 Claims, 2 Drawing Sheets

SKI BINDING LIFTER HAVING INTERNAL FASTENER RETENTION LAYER

FIELD OF THE INVENTION

The subject invention relates to binding lifters for skis, and more specifically to binding lifters having a fastener retention layer.

BACKGROUND OF THE INVENTION

Snow skis often employ lifters, a type of binding support and attachment layer, in order to increase leverage and to raise the ski boot above the snow level to prevent "boot out" during high angled turning of contoured skis. Additionally, lifters provide vibration damping when comprised of a vibration damping material.

Common problems associated with lifters include the addition of weight to the ski, loss of performance at slower speeds and loss of torsional rigidity, due to the vibration damping qualities of the lifter, that results in decreased responsiveness. Prior art lifters have addressed the lack of torsional rigidity by orienting a rigid layer adjacent the exterior surface of the lifter core. While partially successful, the above technique still does not adequately increase response. Other attempts to increase the rigidity of lifters resulted in heavier lifters that increased skier fatigue.

The subject invention addresses the above limitations by surrounding a fastener retention layer, that increases torsional rigidity, with a lifter core that facilitates vibration damping. By encasing the fastener retention layer inside the lifter core, the core now contributes to the binding pull values. This allows the lifter to be lighter, since the fastener retention layer need not be as heavy due to contribution from the core. Lowering the fastener retention layer below the outer surface of the lifter core reduces the bending stiffness effect of the fastener retention layer on the ski, since the fastener retention layer is nearer the neutral axis of the lifter.

SUMMARY OF THE INVENTION

A binding lifter for a ski includes a fastener retention layer, a lifter core surrounding the fastener retention layer and an exterior layer over at least a portion of the lifter core. The fastener retention layer has a greater density than the lifter core. Binding fasteners, such as screws, are securable to the fastener retention layer.

Preferably, the lifter also includes a structural layer surrounding the lifter core and between the lifter core and the exterior layer. When present, the structural layer is preferably comprised of a composite braided material, and is most preferably comprised of biaxial braids at least partially transverse to the longitudinal axis of the lifter. The fastener retention layer is preferably comprised of a sheet of metal and is most preferably titanal, an aluminum alloy. Most preferably, the fastener retention layer has perforations therethrough and the lifter core is comprised of a foam that has passed through the perforations of the fastener retention layer prior to hardening.

Instead of a hardened foam, the lifter core can be comprised of wood or other solid but flexible material. A slot parallel to the longitudinal axis of the lifter core receives the fastener retention layer such that the lifter core surrounds the fastener retention layer.

The above configuration results in a binding lifter having reduced thickness and weight while minimizing the impact on ski bending and retaining high torsional rigidity values. More specifically, by encasing the fastener retention layer inside the lifter core, the core now contributes to the binding pull values. Additionally, by not locating the binding retention layer on the top surface of the lifter, the stiffness effect of the binding retention layer is reduced. When present, the structural layer surrounding the lifter core provides high torsional rigidity that results in quick response at all ski speeds.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
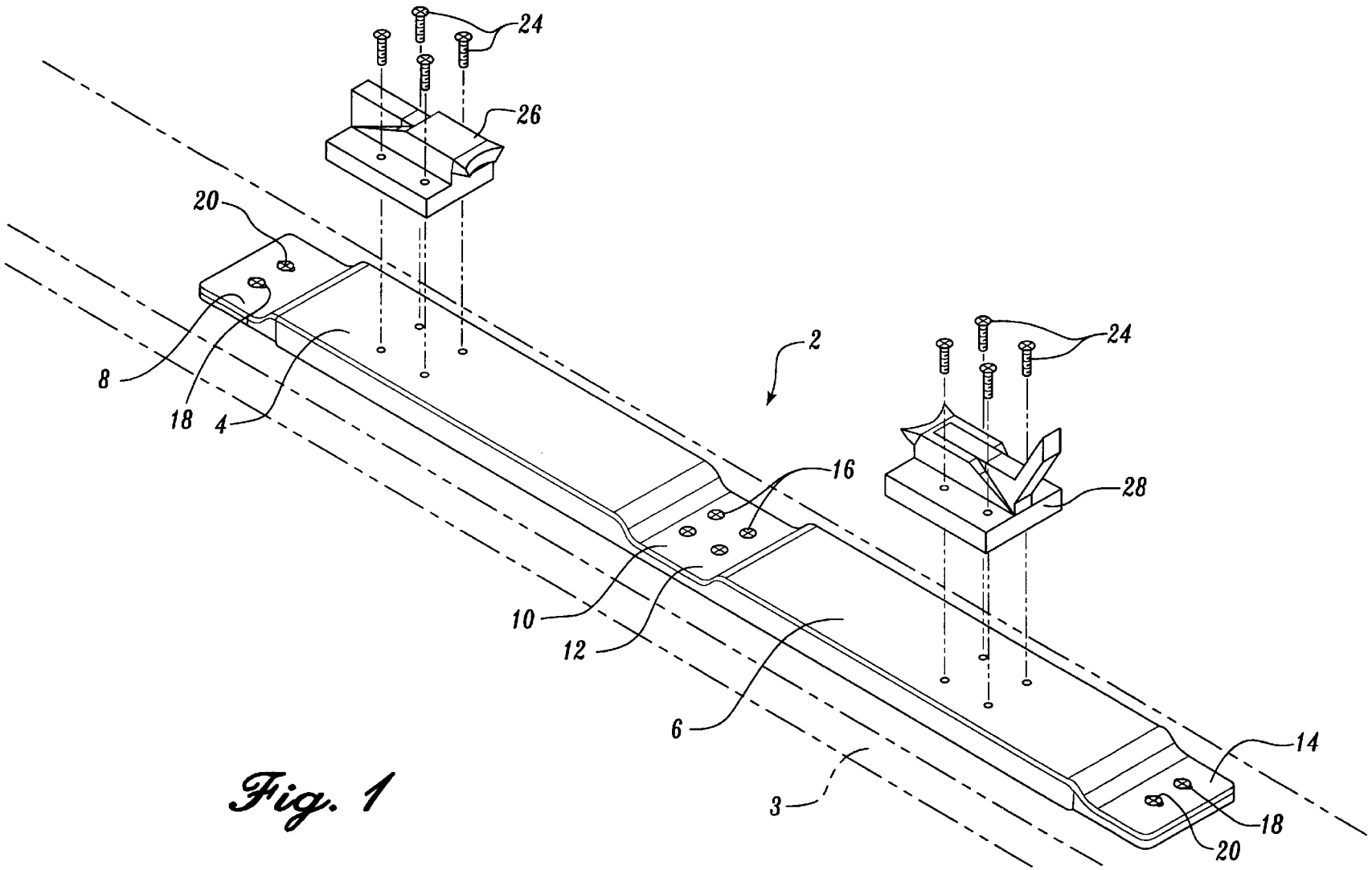
FIG. 1 is a partially exposed perspective view of the lifter of the subject invention.
Figure 2:
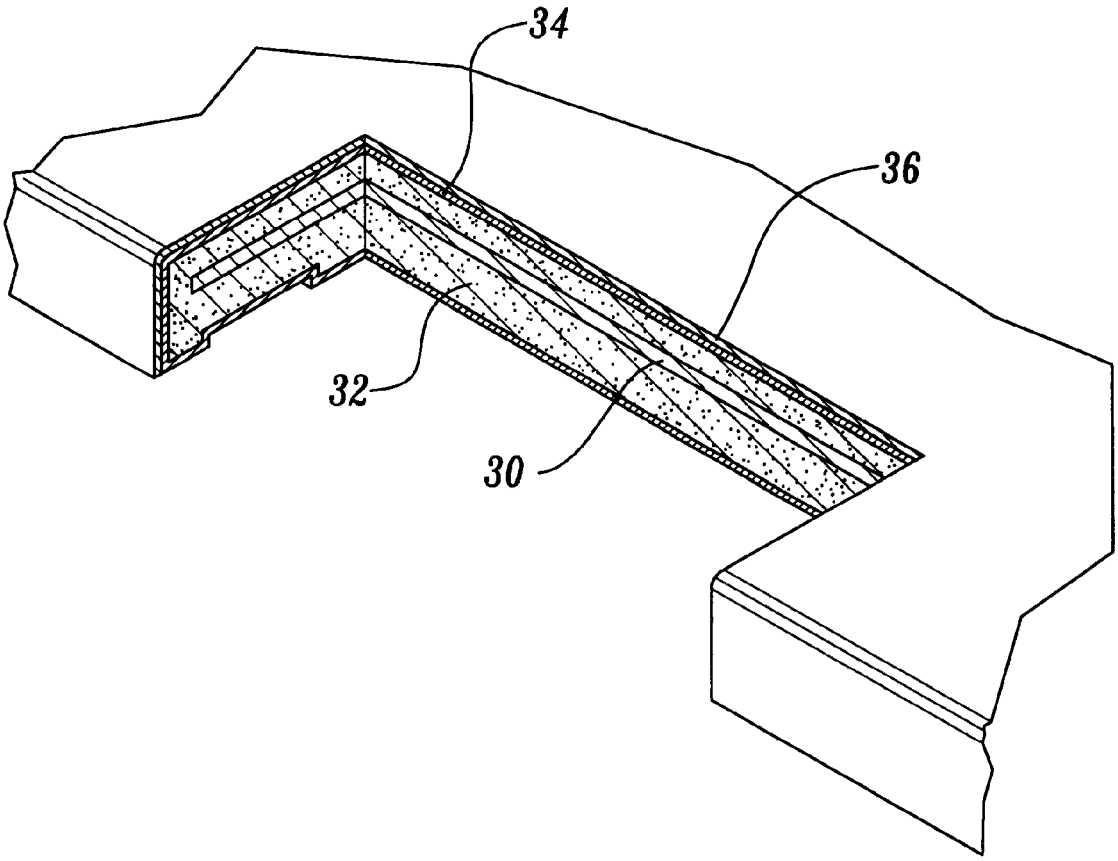
FIG. 2 is a detailed view of the partially exposed portion of FIG. 1.

Referring to FIGS. 1 and 2, binding lifter 2 is located on the upper surface of ski 3, is preferably unitary and is comprised of a front portion 4 and an aft portion 6. Front portion 4 includes sloped front end 8 and sloped rear end 10. Aft portion 6 includes reduced front end 12 and reduced rear end 14. The front portion 4 and aft portion 6 are substantially identically contoured. Thus, only the front portion 4 is described in detail. The front portion 4 includes an elongate, substantially flat, center segment, the upper surface of which defines a first horizontal plane. At either end of the center segment, the front portion 4 bends downwardly, to define a short, angled transition segment. The front portion 4 then bends again to define the front end 8 segment and rear end 10 segment, which extend forwardly and rearwardly, respectively, from the center segment along a common, substantially horizontal plane. The plane defined by the upper surface of the center segment is elevated above and generally parallel to the plane defined by the upper surfaces of the front end 8 segment and rear end 10 segment. Interior screws 16 are located on both sloped rear end 10 of front portion 4 and reduced front end 12 of aft portion 6 and secure front portion 4 and aft portion 6 of binding lifter 2 to ski 3. To further secure binding lifter 2 to ski 3, sloped front end 8 of front portion 4 and reduced rear end 14 of aft portion 6 have exterior screw slots 18 therethrough. Exterior screw slots 18 are elongate and have longitudinal axes parallel to the longitudinal axis of binding lifter 2 and ski 3. Exterior screws 20 pass through exterior screw slots 18 and into ski 3. The elongate configuration of exterior screw slots 18 allows ski 3 to bend horizontally without being substantially encumbered by binding lifter 2, since exterior screws 24, which will move with the bending of ski 3, can travel within exterior screw slots 18 of binding lifter 2. Toe-binding mechanism 26 is located on front portion 4 of binding lifter 2 and heel-binding mechanism 28 is located on aft portion 6 of binding lifter 2 and is longitudinally aligned with toe-binding mechanism 26. Binding screws 24 secure toe-binding mechanism 26 to front portion 4 of binding lifter 2 and secure heel-binding mechanism 28 to aft portion 6 of binding lifter 2. Binding screws 24 are secured in, or pass through, the fastener retention layer 30 of binding lifter 2 described below.

Referring to FIG. 2, binding lifter 2 includes fastener retention layer 30 located within core 32. Fasteners 16 and 20 extend into and perforate fastener retention layer 30.

Fastener retention layer is formed as an elongate sheet that spans the length of lifter 2. Fastener retention layer 30 is preferably comprised of a rigid or semi-rigid sheet of metal, with the metal most preferably being an aluminum alloy such as titanal. Fastener retention layer is preferably about 0.05 inch thick. Core 32 preferably extends above and below fastener retention layer 30 and can be comprised of a foam material such as polyurethane or other foamed synthetic polymer. Alternatively, core 32 can be comprised of wood, or wood laminate. Core 32 is generally comprised of a material that has a density and strength less than the density and strength of fastener retention layer 30. The low density of core 32 facilitates vibration damping of binding lifter 2. When core 32 is comprised of a foam material, fastener retention layer 30 preferably includes a plurality of openings through which core 32 extends to further facilitate interconnection of fastener retention layer 30 and core 32. When core 32 is comprised of wood or wood laminate, a slot is located in core 32 which receives fastener retention layer 30. Orienting fastener retention layer 30 within core 32, as opposed to on an exterior surface of core 32, results in a binding lifter having reduced thickness and weight that minimizes the impact on ski bending and retains high torsional rigidity values. By encasing fastener retention layer 30 in core 32, the core contributes to the binding pull values. This allows binding lifter 2 to be lighter since the fastener retention layer 32 need not be as heavy and thick, due to the contribution from core 32. Additionally, encasing fastener retention layer 30 in core 32 reduces the bending stiffness effect of fastener retention layer 30 on ski 3, since fastener retention layer 30 is in nearer or at the neutral axis of core 32 of binding lifter 2.

Optionally, structural layer 34 surrounds at least a portion of core 32. Structural layer 34 provides high torsional rigidity with low bending stiffness. Structural layer 34 is preferably comprised of a composite braided material such as e-glass, s-glass fiberglass or carbon, and is most preferably comprised of at least biaxial braids that are oriented at least partially transverse to the longitudinal axis of core 32. In one embodiment these braids are oriented at about 45 degrees. An exterior layer comprised of, for example, urethane is located on the exterior surface of core 32 if structural layer 34 is not present; if structural layer 34 is present, exterior layer 36 is located over structural layer 34. Exterior layer 36 is a hardened surface layer that protects binding lifter 2 from the external environment.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A binding lifter onto which bindings are securable, the lifter being securable to a ski, said lifter comprising:

an inner fastener retention layer defining a fastener receiving portion for securely receiving binding fasteners at least partially therethrough;

a core extending above and below said fastener receiving portion of said inner retention layer, said core being constructed from a hard material having a density lower than that of said retention layer; and an exterior layer at least partially surrounding said core, said exterior layer being less rigid than said inner fastener retention layer.

2. The lifter of claim 1, wherein said core completely surrounds said retention layer.

3. The lifter of claim 1, wherein said core comprises a foam material, said retention layer including openings through which said foam core extends.

4. The lifter of claim 1, further comprising a structural layer over at least a portion of said core.

5. The lifter of claim 4, wherein said structural layer comprises a composite braided material.

6. The lifter of claim 5, wherein said structural layer includes at least biaxial braids at least partially transverse to the longitudinal axis of the lifter, so as to be stiff in torsion.

7. The lifter of claim 1, wherein said core comprises wood, said retention layer being sandwiched between portions of said wood core.

8. The lifter of claim 1, wherein said retention layer comprises a sheet of metal.

9. The lifter of claim 8, wherein said sheet comprises titanal.

10. The lifter of claim 1, wherein said binding fasteners are binding screws and wherein said retention layer is positioned within said core, said core covering the top of said retention layer, said retention layer being close enough to the top of said core such that the binding screws extend through a portion of said core above said retention layer and at least partially into said retention layer.

11. The binding lifter onto which bindings are securable, the lifter being securable to a ski, said lifter comprising:

an inner fastener retention layer defining a fastener receiving portion for securely receiving binding fasteners at least partially therethrough;

a core extending above and below said fastener receiving portion of said inner retention layer, said core being constructed from a hard material having a density lower than that of said retention layer;

a structural layer over at least a portion of said core; and an exterior layer at least partially surrounding said structural layer.

12. The lifter of claim 11, wherein said core completely surrounds said retention layer.

13. The lifter of claim 11, wherein said core comprises a foam material, said retention layer including openings through which said foam core extends.

14. The lifter of claim 1, wherein said structural layer comprises a composite braided material.

15. The lifter of claim 14, wherein said structural layer includes at least biaxial braids at least partially transverse to the longitudinal axis of the lifter, so as to be stiff in torsion.

16. The lifter of claim 1, wherein said core comprises wood, said retention layer being sandwiched between portions of said wood core.

17. The lifter of claim 11, wherein said retention layer comprises a sheet of metal.

18. The lifter of claim 17, wherein said sheet comprises titanal.

19. The lifter of claim 11, wherein said binding fasteners are binding screws and wherein said retention layer is positioned within said core, said core covering the top of said retention layer, said retention layer being close enough to the top of said core such that the binding screws extend through a portion of said core above said retention layer and at least partially into said retention layer.

20. A binding lifter onto which bindings are securable, the lifter being securable to a ski, said lifter comprising:

an inner fastener retention layer defining a fastener receiving portion for securely receiving binding fasteners at least partially therethrough;

a core extending above and below said fastener receiving portion of said inner retention layer, said core having a density lower than that of said retention layer; and an exterior layer at least partially surrounding said core, wherein said core comprises a foam material, said retention layer including openings through which said foam core extends.

21. The lifter of claim 20, wherein said core completely surrounds said retention layer.

22. The lifter of claim 20, further comprising a structural layer over at least a portion of said core.

23. The lifter of claim 22, wherein said structural layer comprises a composite braided material.

24. The lifter of claim 23, wherein said structural layer includes at least biaxial braids at least partially transverse to the longitudinal axis of the lifter, so as to be stiff in torsion.

25. The lifter of claim 20, wherein said core comprises wood, said retention layer being sandwiched between portions of said wood core.

26. The lifter of claim 20, wherein said retention layer comprises a sheet of metal.

27. The lifter of claim 26, wherein said sheet comprises titanal.

28. The lifter of claim 20, wherein said binding fasteners are binding screws and wherein said retention layer is positioned within said core, said core covering the top of said retention layer, said retention layer being close enough to the top of said core such that the binding screws extend through a portion of said core above said retention layer and at least partially into said retention layer.

* * * * *

UNITED STATES PATENT AND TRADEMARK OFFICE

CERTIFICATE OF CORRECTION

PATENT NO. : 6,102,427
DATED : August 15, 2000
INVENTOR(S) : A.O. DeRocco et al.

It is certified that error appears in the above-identified patent and that said Letters Patent is hereby corrected as shown below:

Column 4,
(Claim 14, line 1), line 38, "claim 1," should read --claim 11,--
(Claim 16, line 1), line 43, "claim 1," should read --claim 11,--

Signed and Sealed this

Twenty-sixth Day of June, 2001

*Attest:*

Nicholas P. Godici

NICHOLAS P. GODICI
*Acting Director of the United States Patent and Trademark Office*

*Attesting Officer*